US006848947B2

(12) United States Patent
Chimiak

(10) Patent No.: US 6,848,947 B2
(45) Date of Patent: Feb. 1, 2005

(54) CROSS-CONNECTOR FOR INTERFACING MULTIPLE COMMUNICATION DEVICES

(76) Inventor: William J. Chimiak, 1004 Shreve Ct., Crofton, MD (US) 21114-2893

( * ) Notice: Subject to any disclaimer, the term of this patent is extended or adjusted under 35 U.S.C. 154(b) by 0 days.

(21) Appl. No.: 10/444,444

(22) Filed: May 23, 2003

(65) Prior Publication Data

US 2004/0235356 A1 Nov. 25, 2004

(51) Int. Cl.[7] ..... H01R 33/92
(52) U.S. Cl. ..... 439/638; 439/941; 439/676
(58) Field of Search ..... 439/638, 941, 439/676, 636

(56) References Cited

U.S. PATENT DOCUMENTS

| | | | | | |
|---|---|---|---|---|---|
| T958,009 | I4 | | 5/1977 | Snyder | |
| 4,061,411 | A | | 12/1977 | Gumb et al. | |
| 4,241,974 | A | | 12/1980 | Hardesty | |
| 4,362,905 | A | | 12/1982 | Ismail | |
| 4,444,451 | A | | 4/1984 | Myers | |
| 4,579,407 | A | * | 4/1986 | Shimada | 439/502 |
| 5,310,363 | A | * | 5/1994 | Brownell et al. | 439/676 |
| 5,328,390 | A | | 7/1994 | Johnston et al. | |
| 5,333,408 | A | * | 8/1994 | Simmons | 43/54.1 |
| 5,425,172 | A | | 6/1995 | Carswell et al. | |
| 5,432,484 | A | * | 7/1995 | Klas et al. | 333/1 |
| 5,618,185 | A | * | 4/1997 | Aekins | 439/76.1 |
| 5,931,703 | A | | 8/1999 | Aekins | |
| 6,146,207 | A | | 11/2000 | Mulot | |
| 6,270,358 | B1 | | 8/2001 | Nozick | |
| 6,302,741 | B1 | * | 10/2001 | Fasold et al. | 439/620 |
| 6,340,313 | B1 | | 1/2002 | Hwang | |
| 2003/0008564 | A1 | * | 1/2003 | Lebron | 439/638 |

FOREIGN PATENT DOCUMENTS

| | | | |
|---|---|---|---|
| GB | 2 292 485 | * | 2/1994 |

* cited by examiner

*Primary Examiner*—Tho D. Ta
*Assistant Examiner*—Larisa Tsukerman
(74) *Attorney, Agent, or Firm*—Summa & Allan, P.A.

(57) ABSTRACT

A cross-connector capable of connecting communication lines between a variety of communication devices comprises in one embodiment a first housing having eight primary leads, a second housing having eight secondary leads, a plurality of conductive paths within the first and second housings that connect at least one primary lead to at least one secondary lead, and an actuator for releasably securing the cross-connector to a communication device. A communication network that incorporates the cross-connector comprises in one embodiment a first communication device, a second communication device, a cross-connector that connects the first and second communication devices, a first network cable that connects the first communication device to the cross-connector, and optionally, a second network cable that connects the second communication device to the cross-connector.

38 Claims, 2 Drawing Sheets

CROSS-CONNECTOR FOR INTERFACING MULTIPLE COMMUNICATION DEVICES

FIELD OF THE INVENTION

The invention relates to an apparatus for cross-connecting communication devices. In particular, the invention relates to a cross-connector capable of connecting multiple communication devices in an Ethernet network such as routers, switches, hubs, and personal computers that minimizes the space required for a local network and facilitates test and evaluation procedures. In another embodiment, the invention is used on conjunction with T1 data network installations.

BACKGROUND OF THE INVENTION

Engineers created the original Ethernet network by physically cabling multiple communication devices together (e.g., a personal computer and printer). The original Ethernet described communication over a single cable shared by all devices on the network. Thus, once a device was attached to the cable, it could communicate with any other attached device. Unfortunately, a single shared cable limits the size of the Ethernet network. In later stages of development, engineers incorporated routers into the Ethernet network. Routers are capable of dividing a single network into two logically separate networks. As configured, the router forms a logical boundary between two or more individual networks stemming from the same originating network.

Historically, the original Ethernet networks included long runs of coaxial cable that provided attachment for multiple stations (i.e., devices). More recently, modern Ethernet networks incorporate twisted pair wiring or fiber optics to connect stations in a radial pattern. Further, modern Ethernet networks incorporate switches that connect multiple individual stations or segments.

As described, known Ethernet networks include unshielded twisted pair cable (e.g., copper cabling). Accordingly, network engineers typically use a RJ45 connector for network connections. Specifically, engineers incorporate RJ45 connectors in Ethernet local area networks (LANs) when conducting pre-installation configuration, equipment demonstration, or system troubleshooting. RJ45 connectors are used to connect hardware, for example, between a patch panel in a wiring closet and a workstation including file servers, patch bays, and other devices in the network.

In certain situations, however, the standard RJ45 connector limits the number of devices that a network engineer can incorporate into a particular network. For example, if a network configuration or a troubleshooting technique requires that a personal computer (PC) connect to another PC, and a cross-connection is not provided, then the connection is not possible due to incompatible signal paths. Likewise, if a network configuration or troubleshooting technique requires that a hub connect to another hub, or that a hub connect to a router, and a cross-connection is not provided, then the network engineer is unable to configure the network structure or to properly evaluate an inoperable communication device (e.g., hub). Thus, there is a need for an apparatus that provides a cross-connection between varieties of communication devices in an Ethernet network.

Further, if an uplink port of a hub incorporates an older BNC (British Naval Connector or Bayonet Nut Connector) connector, the hub is unusable. Thus, there is a need for an apparatus that provides a cross-connection between a hub incorporating a BNC connector and another communication device, such as another hub.

In these situations, the options available to the network engineer seeking to interconnect multiple devices are somewhat limited. First, the network engineer may purchase or construct a cumbersome Ethernet crossover cable. This option is costly, labor intensive, and utilizes valuable space when working in close quarters (i.e., small areas behind local servers and shelves supporting telecommunication links). Another option is to purchase known palm-size hubs and switches that are rather bulky and range in price from $40 to hundreds of dollars and also require additional power. Both options (i.e., cross-over cables or palm-size hubs) take up valuable space in an engineer's laptop case or network monitor case. Thus there is a need for a compact and inexpensive apparatus that provides a cross-connection between known Ethernet communication devices.

A network engineer attempting to connect T1 circuits with local networks faces the same dilemma described above when incorporating RJ45 (or RJ48) connectors. Thus there is a need for an apparatus that provides the cross-connection between known T1 communication devices and a local private network (e.g., public switch telephone network (PSTN) to the Digital Service. Unit/Channel Service Unit (DSU/CSU) of a router or switch).

A more desirable option is to provide a compact connector having a male RJ45 first end and a female RJ45 second end, wherein the connector is internally configured (i.e., wired) to perform the crossover function. Briefly, the connector is a collapsed crossover cable enclosed within a housing (hereinafter referred to as a "cross-connector"). Such an apparatus provides the field network engineer or network administrator an inexpensive and useful cross-connector. Further, such a cross-connector facilitates the quick connection of a PC to another PC creating a quick two-node network for test and evaluation.

OBJECT AND SUMMARY OF THE INVENTION

It is therefore an object of the present invention to provide an apparatus for cross-connecting a variety of communication devices in an Ethernet network (e.g., hub to hub, hub to switch, hub to router, router to PC, switch to switch, and PC to PC).

Another object of the invention is the provision of an apparatus for cross-connecting a variety of communication devices in a T1 communication network (e.g., PSTN to a DSU/CSU in a router, and PSTN to a DSU/CSU in a switch).

A further object of the invention is to increase the efficient use of space associated with installing and testing networks by eliminating the use of bulky palm hubs and lengthy cross-connector cables.

Yet another object of the invention is to reduce the costs associated with installing and testing networks by eliminating the necessity for network engineers to purchase device-specific cross-connector devices.

The invention meets these objectives with a cross-connector capable of connecting a variety of communication devices in a local Ethernet network. In particular, the invention is an apparatus having a plurality of conductive paths configured to provide the cross-over function between a variety of communication devices. In another aspect, the invention is a network connector for interfacing communication devices that incorporates the apparatus wherein the apparatus connects the communication devices with a plurality of network cables.

The foregoing and other objects and advantages of the invention and the manner in which the same are accomplished will become clearer based on the following detailed description taken in conjunction with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
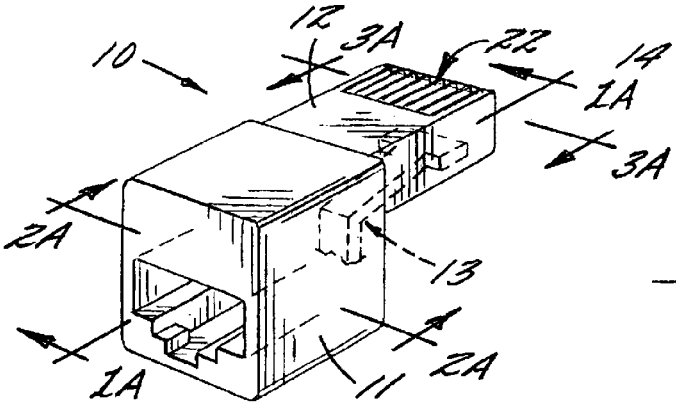
FIG. 1 is a perspective view of a preferred embodiment of the cross-connector illustrating a first housing, a second housing, and an actuator.

An overall view of the cross-connector 10 which incorporates features of the present invention is set forth in FIG. 1. As used herein, the term "Ethernet network" is used to describe a local area network having any number of communication devices (e.g., router or switch) that communicate based on the protocol defined by the Institute of Electrical and Electronics Engineers (IEEE), namely IEEE 802.3, and that are connected by communication lines (e.g., cables, twisted pair wiring, or fiber optics). With reference to the orientation of the cross-connector 10 in FIG. 1, it will be understood that the term "length" refers to a distance measured from the leftmost portion of the cross-connector to the rightmost portion of the cross-connector. It will be further appreciated by those of ordinary skill in the art that, as used herein, the concept of a first housing being connected to a second housing merely describes the relative positions of the first and second housings within the cross-connector 10 structure.

As depicted in FIG. 1, the cross-connector 10 includes a first housing 11, a second housing 12, and an actuator 13. In a preferred embodiment, the first housing 11 defines the female end (F) of the cross-connector 10 and the second housing 12 defines the male end (M) of the cross-connector. As illustrated in the preferred embodiment of FIG. 1, the cross-sectional area of the first housing 11 is larger than the cross-sectional area of the second housing 12. Further, the first and second housings 11,12 are preferably rectangular in shape. In a preferred embodiment, the first and second housings 11,12 are made from polymeric material such as polyethylene or polypropylene.

Figure 2:
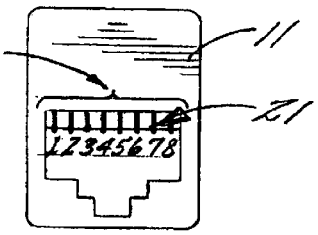
FIG. 2 is front elevated view of a preferred embodiment of the cross-connector depicting the first housing, eight primary leads of the first housing, and a first conductive sleeve.
Figure 3:
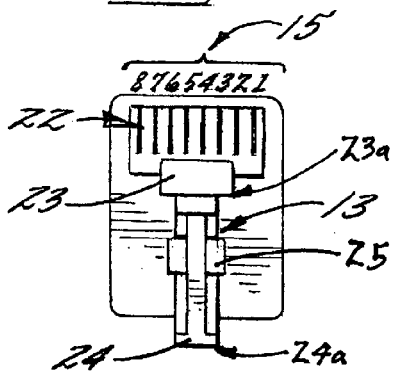
FIG. 3 is a rear elevated view of a preferred embodiment of the cross-connector depicting the second housing, eight secondary leads of the second housing, a second conductive sleeve, and the actuator.

As depicted in FIG. 2, the first housing 11 includes a first, second, third, fourth, fifth, sixth, seventh, and eighth primary lead 14 (numbered 1–8) that are positioned at one end of the first housing. As depicted in FIG. 3, the second housing 12 includes a first, second, third, fourth, fifth, sixth, seventh, and eighth secondary lead 15 (numbered 1–8) that are positioned at one end of the second housing. The second housing 12 is connected to the first housing 11 such that the primary leads 14 and secondary leads 15 are positioned at opposing ends of the cross-connector 10. The primary and secondary leads 14,15 are preferably made from copper or aluminum.

Figure 4:
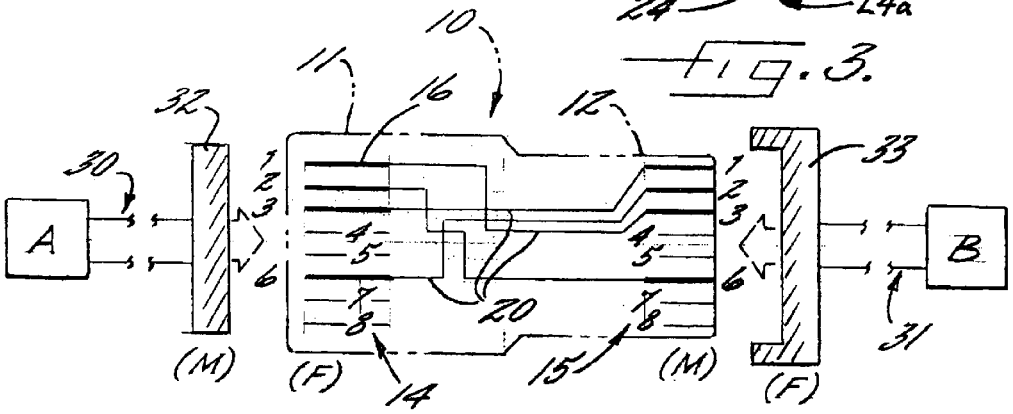
FIG. 4 is a schematic diagram of a preferred embodiment of the cross-connector illustrating a plurality of conductive paths configured to connect a select number of primary leads to a select number of secondary leads for use in connecting an Ethernet network.
Figure 5:
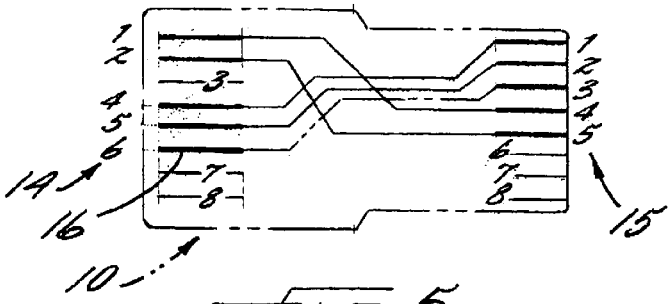
FIG. 5 is a schematic diagram of a preferred embodiment of the cross-connector illustrating a plurality of conductive paths configured to connect a select number of primary leads to a select number of secondary leads for use in connecting T1 communication lines to a DSU/CSU if required by the T1 termination.

With reference to FIGS. 4 and 5, the first and second housings 11,12 contain a plurality of conductive paths 20 (numbered 1–8). As illustrated, the conductive paths 20 connect at least one primary lead of the first housing 11 to at least one secondary lead of the second housing 12. In a preferred embodiment of the cross-connector 10, the conductive paths 20 are formed from insulated wires 16. The insulated wires 16 are preferably made form copper or aluminum In a preferred embodiment of the cross-connector 10 as used in connection with an Ethernet network and as illustrated in FIG. 4, the plurality of conductive paths 20 include a first, second, third, and fourth conductive path that connects the first, second, third, and sixth primary leads 14 of the first housing 11 to the third, sixth, first, and second secondary leads 15 of the second housing 12, respectively. As configured, the conductive paths 20 facilitate the transmission and receipt of proper signals between communication lines of an Ethernet network. For example, the cross-connector 10 is capable of connecting communication device A and communication device B. Specifically, in the configuration as depicted in FIG. 4, the cross-connector 10 is capable of connecting communication lines between devices A and B, wherein A and B are, for example, two hubs, a hub and a switch, a hub and a router, a router and a PC, two switches, or two PCs, respectively.

In another preferred embodiment of the cross-connector 10 as used in connection with T1 communication lines and as illustrated in FIG. 5, the plurality of conductive paths 20 include a first, second, third, and fourth conductive path that connects the first, second, fourth, and fifth primary leads 14 of the first housing 11 to the fourth, fifth, first, and second secondary leads 15 of the second housing 12, respectively. Specifically, in the configuration as depicted in FIG. 5, the cross-connector 10 is capable of connecting communication lines between a public switched telephone network (PSTN) and a DSU/CSU of a router in a private LAN. Alternatively, the cross-connector 10 is also capable of connecting communication lines between the PSTN and a DSU/CSU of a switch in a private LAN.

An alternative configuration of the cross-connector 10 as used in connection with T1 communication lines is also depicted in FIG. 5. As configured, the plurality of conductive paths 20 may include a first, second, third, fourth, and fifth conductive path that connects the first, second, fourth, fifth, and sixth primary leads 14 of the first housing 11 to the fourth, fifth, first, second, and third secondary leads 15 of the second housing 12, respectively. In this configuration, the fifth conductive path that connects the sixth primary lead to the third secondary lead is optional. Likewise, in this configuration, the cross-connector 10 is capable of connecting communication lines between the PSTN and the DSU/CSU of a router in a LAN, and the PSTN and the DSU/CSU of a switch in a LAN.

In a typical T1 communication line, a LAN is connected to the PSTN. The junction between the PSTN and the private network is known to those skilled in the art as the "point of demarcation." At this point, the PSTN lines are connected to the lines of the LAN. This point of demarcation generally occurs prior to a standard wall jack. Most local networks incorporate a RJ45 jack to connect the local network to the public network. Oftentimes the wiring in a T1 termination is incorrectly installed (i.e., wired) such that the connections are reversed; thus, rendering the connection inoperable and requiring an engineer to rewire the termination. Advantageously, the present invention is capable of cross-connecting the improperly wired termination point so that the connection is operable.

Advantageously, the cross-connector 10 connects the RJ-45 directly to a DSU/CSU. The DSU/CSU is then connected to either a router or a switch. It will be understood by those skilled in the art that the CSU is a telephony interface to the central office of the telephone network. The CSU provides, among other functions, circuit termination, hazardous voltage isolation, impedance matching, and most importantly, signal conditioning. The central office generally provides the CSU. It will further be understood by those skilled in the art that the DSU converts synchronous signals originating from the central office into bipolar signals. Generally, when connecting the T1 line to the LAN, the engineer uses a DSU/CSU connection to a router or switch to establish communications, provided the local telephone company and DSU/CSU have the correct T1 termination.

Specifically, reverse wired T1 terminations result in time delays in determining the party responsible for the incompatible wiring (i.e., telephone company or DSU/CSU equipment provider). The cross-connector eliminates the need to rewire the termination or reorder and reinstall new equipment. Stated differently, the present invention alleviates discrepancies between the local telephone company and DSU/CSU equipment provider as to the type of T1 termination required to correct a reverse wired termination.

As shown in FIGS. 2 and 3, the cross-connector 10 also includes a first conductive sleeve 21 and a second conductive sleeve 22 preferably positioned in the first housing 11 and second housing 12, respectively. The first and second conductive sleeves 21, 22 are defined by interior surfaces of the first and second housings 11, 12, respectively. The first conductive sleeve 21 supports the primary leads 14 and is positioned adjacent the primary leads. The second conductive sleeve 22 supports the secondary leads 15 and is positioned adjacent the secondary leads. In the preferred embodiment of the cross-connector 10, the first and second conductive sleeves 21, 22 may be gold-plated.

Figure 1A:
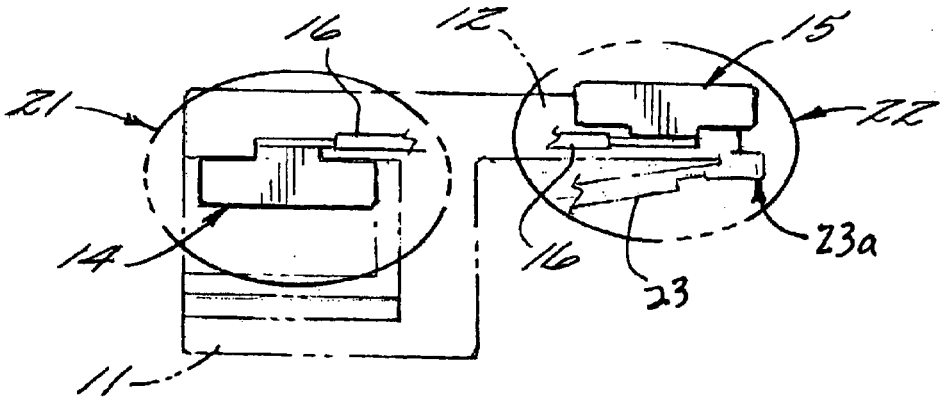
Figure 2A:
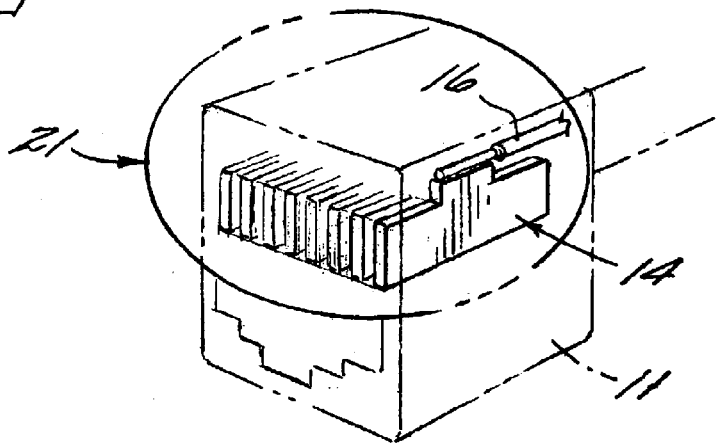
Figure 3A:
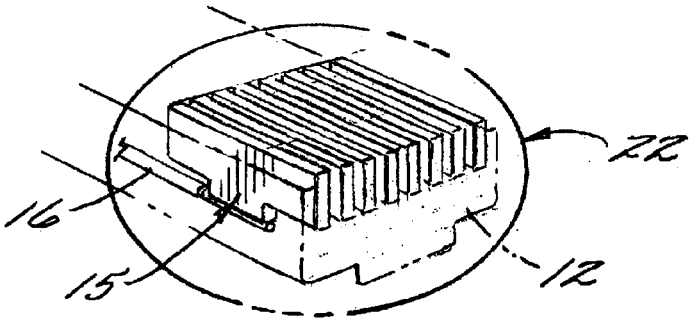

With reference to FIGS. 1 and 3, the flexible actuator 13 is preferably L-shaped. The actuator 13 includes a first arm 23 having an end 23*a* and a second arm 24 having a free end 24*a* (see FIGS. 1, 1A, and 3). The end 23*a* of first arm 23 extends from an end of the second housing 12 opposite the first housing 11 to an area adjacent to the first housing 11 (i.e., to an end of the second arm 24 opposite the free end 24*a* of the second arm). The second arm 24 extends from the area adjacent the first housing 11 (i.e., from an end of the first arm 23 opposite the end 23*a*) to an area below the second housing 12 (i.e., to the free end 24*a* of the second arm). Preferably, the first and second arms 23, 24 define substantially perpendicular planes (see FIG. 1). Referring to FIG. 3, a bracket 25 secured to the second housing defines an opening through which a portion of the second arm 24 travels. Thus, the actuator 13 is slidably secured to a side of the first housing 11 to which the second housing 12 is secured. The bracket 25 maintains the position of the second arm 24 relative to the second housing 12 and permits the second arm to reciprocate upward and downward. Stated differently, pressure applied upwardly against the free end 24*a* of the second arm 24—positioned below the second housing 12—advances portions of the second arm 24 through the opening in the bracket 25 and causes the end 23*a* of the first arm 23 to move the second housing and thereby eject the second housing from a communication device. In other words, the perpendicular relationship between the flexible first and second arms 23, 24 results in movement of one arm in reaction to movement of the other arm. The end 23*a* of the first arm 23 is preferably secured to the second housing 12 so that movement of the first arm 23 applies force against the second housing (see FIG. 1A). Accordingly the first arm 23 is moveable along the length of the second housing 12 such that the first arm ejects the second housing from a communication device when an operator depresses the second arm 24. In operation, the actuator 13 releasably secures the cross-connector 10, and specifically the second housing 12, to a communication device (e.g., hub or PC) when the cross-connector is used in conjunction with an Ethernet network. Alternatively, the actuator 13 releasably secures the second housing 12 to a DSU/CSU when the cross-connector is used in conjunction with a T1 communication line. The actuator 13 is further capable of releasably securing the cross-connector 10 to a jack positioned at one end of a network cable.

Another aspect of the present invention, as illustrated in FIG. 4, includes a communication network that incorporates the cross-connector 10. In a preferred embodiment, the communication network interfaces communication devices A and B of an Ethernet network. The network preferably includes a first communication device A, a second communication device B, a cross-connector 10, a first network cable 30, and, optionally, a second network cable 31. The first and second network cables 30,31 include a male jack 32 and female jack 33 positioned at one end of the respective cables. The cross-connector 10 connects the first and second communication devices A and B. Specifically, the male jack 32 of the first network cable 30 connects the first communication device A to the cross-connector 10. In a preferred embodiment, the male end (M) of the cross-connector 10 plugs directly into a female jack of the second communication device B. In an alternative embodiment, the second network cable 31 is incorporated into the communication network. Specifically, the female jack (F) of the second network cable 31 receives the male end (M) of the cross-connector 10. In this embodiment, the opposite end of the second network cable 31 connects communication device B to the cross-connector 10. Accordingly, in this embodiment, the cross-connector 10 connects two communication devices A and B via the first and second network cables 30,31.

The communication network incorporates the cross-connector 10 as described above. Specifically, the communication network incorporates the embodiment of the cross-connector 10 wherein the plurality of conductive paths 20 include a first, second, third, and fourth conductive path that connects the first, second, third, and sixth primary leads 14 to the third, sixth, first, and second secondary leads 15, respectively. Accordingly, the cross-connector 10 is capable of connecting a first network cable 30 connected to communication device A, and a second network cable 31 connected to communication device B, wherein the communication devices A and B are either two hubs, a hub and a switch, a hub and a router, a router and a personal computer, two switches, or two PCs, respectively.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. A cross-connector for interfacing communication devices, said cross-connector comprising:

a first housing having first, second, third, fourth, fifth, sixth, seventh, and eighth primary leads positioned at one end of said first housing, said first housing defining a female end of the cross-connector;

a second housing having first, second, third, fourth, fifth, sixth, seventh, and eighth secondary leads positioned at one end of said second housing, said second housing connected to said first housing such that said primary leads and said secondary leads are positioned at opposing ends of the cross-connector, said second housing defining a male end of the cross-connector;

a plurality of conductive paths within said first and second housings, said plurality of conductive paths connecting at least one primary lead of said first housing to at least one secondary lead of said second housing, said conductive paths including first, second, third, and fourth conductive paths that connect said first, second, third, and sixth primary leads of said first housing to said third, sixth, first, and second secondary leads of said second housing, respectively; and an actuator for releasably securing said second housing to a communication device, said actuator slidably secured to a side of said first housing to which said second housing is secured;

wherein said actuator includes a first arm and a second arm, said first arm moveable along the length of said second housing such that said first arm ejects said second housing from a communication device when an operator depresses said second arm.

2. A cross-connector according to claim 1, wherein said first and second housings are substantially rectangular.

3. A cross-connector according to claim 1, wherein said first and second housings are made from polymeric material.

4. A cross-connector according to claim 1, wherein said primary and secondary leads are made from material selected from the group consisting of copper and aluminum.

5. A cross-connector according to claim 1, wherein said conductive paths comprise insulated wires.

6. A cross-connector according to claim 5, wherein said insulated wires are made from material selected from the group consisting of copper and aluminum.

7. A cross-connector according to claim 1, wherein said conductive paths connect communication lines of a communication network.

8. A cross-connector according to claim 1, wherein said conductive paths connect communication lines between two hubs.

9. A cross-connector according to claim 1, wherein said conductive paths connect communication lines between a hub and a switch.

10. A cross-connector according to claim 1, wherein said conductive paths connect communication lines between a hub and a router.

11. A cross-connector according to claim 1, wherein said conductive paths connect communication lines between a router and a personal computer.

12. A cross-connector according to claim 1, wherein said conductive paths connect communication lines between two switches.

13. A cross-connector according to claim 1, wherein said conductive paths connect communication lines between two personal computers.

14. A cross-connector according to claim 1, further comprising:

a first conductive sleeve positioned adjacent said primary leads of said first housing, said first conductive sleeve supporting said primary leads; and a second conductive sleeve positioned adjacent said secondary leads of said second housing, said second conductive sleeve supporting said secondary leads.

15. A cross-connector according to claim 14, wherein said first and second conductive sleeves are gold-plated.

16. A cross-connector for interfacing communication devices, said cross-connector comprising:

a first housing defining a female end;

a second housing defining a male end, said second housing connected to said first housing;

first, second, third, fourth, fifth, sixth, seventh, and eighth primary leads positioned at said female end of said first housing;

first, second, third, fourth, fifth, sixth, seventh, and eighth secondary leads positioned at said male end of said second housing such that said primary leads and said secondary leads are positioned at opposing ends of the cross-connector;

a plurality of conductive paths housed within said first and second housings, said plurality of conductive paths connecting at least one primary lead of said female end to at least one secondary lead of said male end, said conductive paths including first, second, third, and fourth conductive paths that connect said first, second, fourth, and fifth primary leads of said female end to said fourth, fifth, first, and second secondary leads of said male end, respectively;

a first conductive sleeve positioned at said female end of said first housing that supports said primary leads;

a second conductive sleeve positioned at said male end of said second housing that supports said secondary leads; and an L-shaped actuator for releasably securing said second housing to a communication device, said actuator slidably secured to said first housing;

wherein said actuator includes a first arm and a second arm, said first arm moveable along the length of said male end such that said first arm ejects said second housing from a communication device when an operator depresses said second arm.

17. A cross-connector according to claim 16, wherein said first and second housings are made from polymeric material.

18. A cross-connector according to claim 16, wherein said primary and secondary leads are made from material selected from the group consisting of copper and aluminum.

19. A cross-connector according to claim 16, wherein said conductive paths comprise insulated wires made from material selected from the group consisting of copper and aluminum.

20. A cross-connector according to claim 16, wherein said conductive paths connect communication lines between a public switched telephone network and a digital service unit/channel service unit of a router.

21. A cross-connector according to claim 16, wherein said conductive paths connect communication lines between a public switched telephone network and a digital service unit/channel service unit of a switch.

22. A cross-connector according to claim 16, wherein said first and second conductive sleeves are gold-plated.

23. A communication network for interfacing communication devices, said network comprising:

a first communication device;

a second communication device;

a cross-connector that connects said first communication device to said second communication device, said cross-connector comprising:

a first housing;

a second housing connected to said first housing;

an actuator for releasably securing said second housing to one of said communication devices;

first, second, third, fourth, fifth, sixth, seventh, and eighth primary leads positioned at one end of said first housing;

first, second, third, fourth, fifth, sixth, seventh, and eighth secondary leads positioned at one end of said second housing said second housing connected to said first housing such that said primary leads and said secondary leads are positioned at opposing ends of the cross-connector; and a plurality of conductive paths within said first and second housings, said plurality of conductive paths connecting at least one primary lead of said first housing to at least one secondary lead of said second housing; and a first network cable that connects said first communication device to said cross-connector, wherein said actuator is slidably secured to a side of said first housing to which said second housing is secured and includes a first arm and a second arm, said first arm moveable along the length of said second housing such that said first arm ejects said second housing from one of said communication devices when an operator depresses said second arm; and wherein said conductive paths include first, second, third, and fourth conductive paths that connect said first, second, third, and sixth primary leads of said first housing to said third, sixth, first, and second secondary leads of said second housing, respectively.

24. A communication network according to claim 23, further comprising a second network cable that connects said second communication device to said cross-connector.

25. A cross-connector according to claim 23, wherein said first and second housings are substantially rectangular.

26. A cross-connector according to claim 23, wherein said first housing defines a female end of the cross-connector and said second housing defines a male end of the cross-connector.

27. A cross-connector according to claim 23, wherein said first and second housings are made from polymeric material.

28. A cross-connector according to claim 23, wherein said primary and secondary leads are made from material selected from the group consisting of copper and aluminum.

29. A cross-connector according to claim 23, wherein said conductive paths comprise insulated wires.

30. A cross-connector according to claim 29, wherein said insulated wires are made from material selected from the group consisting of copper and aluminum.

31. A communication network according to claim 23, wherein:

said first communication device is a hub; and said second communication device is a hub.

32. A communication network according to claim 23, wherein:

said first communication device is a hub; and said second communication device is a switch.

33. A communication network according to claim 23, wherein:

said first communication device is a hub; and said second communication device is a router.

34. A communication network according to claim 23, wherein:

said first communication device is a router; and said second communication device is a personal computer.

35. A communication network according to claim 23, wherein:

said first communication device is a switch; and said second communication device is a switch.

36. A communication network according to claim 23, wherein:

said first communication device is a personal computer; and said second communication device is a personal computer.

37. A cross-connector according to claim 23, wherein said cross-connector further comprises:

a first conductive sleeve positioned adjacent said primary leads of said first housing, said first conductive sleeve supporting said primary leads; and a second conductive sleeve positioned adjacent said secondary leads of said second housing, said second conductive sleeve supporting said secondary leads.

38. A cross-connector according to claim 37, wherein said first and second conductive sleeves are gold-plated.

* * * * *

UNITED STATES PATENT AND TRADEMARK OFFICE

CERTIFICATE OF CORRECTION

PATENT NO. : 6,848,947 B2
DATED : February 1, 2005
INVENTOR(S) : William J. Chimiak It is certified that error appears in the above-identified patent and that said Letters Patent is hereby corrected as shown below:

Column 4,
Line 25, "form" should read -- from --.

Signed and Sealed this

Tenth Day of May, 2005

JON W. DUDAS
*Director of the United States Patent and Trademark Office*